US006408664B1

(12) United States Patent
Williams

(10) Patent No.: US 6,408,664 B1
(45) Date of Patent: Jun. 25, 2002

(54) HYDRAULIC POSITIONING ASSEMBLY FOR COLD ROLLING TUBES

(75) Inventor: James O. Williams, Marlborough, MA (US)

(73) Assignee: Anvil International, Decatur, IL (US)

( * ) Notice: Subject to any disclaimer, the term of this patent is extended or adjusted under 35 U.S.C. 154(b) by 0 days.

(21) Appl. No.: 09/630,496

(22) Filed: Aug. 2, 2000

Related U.S. Application Data

(60) Provisional application No. 60/146,848, filed on Aug. 3, 1999, and provisional application No. 60/146,849, filed on Aug. 3, 1999.

(51) Int. Cl.[7] ..... B21D 15/04

(52) U.S. Cl. ..... 72/105; 72/101; 72/106

(58) Field of Search ..... 72/101, 105, 106, 72/110, 115, 117, 118, 120, 121, 124

(56) References Cited

U.S. PATENT DOCUMENTS

| | | | | |
|---|---|---|---|---|
| 1,284,093 A | | 11/1918 | Grotness | |
| 1,463,073 A | | 7/1923 | Felten | |
| 1,541,601 A | | 6/1925 | Tribe | |
| 2,267,533 A | | 12/1941 | O'Brien | |
| 2,617,466 A | | 11/1952 | Kradoska | |
| 2,689,752 A | | 9/1954 | Webster | |
| 3,191,416 A | | 6/1965 | Prtchett | |
| 3,290,914 A | | 12/1966 | Vaill et al. | |
| 3,299,680 A | * | 1/1967 | Thompson | 72/121 |
| 3,367,160 A | * | 2/1968 | Sperber et al. | 72/101 |
| 3,995,466 A | | 12/1976 | Kunsman | |
| 4,408,788 A | | 10/1983 | Beukema | |
| 4,429,445 A | | 2/1984 | Fuminier | |
| 5,279,143 A | | 1/1994 | Dole | |
| 5,450,738 A | | 9/1995 | Chatterley et al. | |
| 5,528,919 A | | 6/1996 | McGrady et al. | |
| 5,570,603 A | * | 11/1996 | Chatterly et al. | 72/101 |
| 5,778,715 A | | 7/1998 | Lippka et al. | |
| 6,070,443 A | | 6/2000 | Sato et al. | |

FOREIGN PATENT DOCUMENTS

| | | | | |
|---|---|---|---|---|
| DE | 535059 | | 10/1931 | |
| GB | 18201 | | 6/1916 | |
| JP | 57-94423 | | 6/1982 | |
| JP | 57-177811 | * | 11/1982 | 72/121 |
| JP | 1-95836 | * | 4/1989 | 72/105 |

OTHER PUBLICATIONS

"The Copper Connection" (Victaulic, 05/90), 12 pages.
"AWWA Standard for Grooved and Shouldered Joints" (American Water Works Associate, May 1987), 10 pages.
"Expanded Pipe Coupling Style 24" (Vitaulic, 1985), 4 pages.
"Gruvlok® Products for Grooved Piping Systems" (Grinnell Corporation, Sep. 1991) 60 pages.
"Gruvlok® Pipe Machines" (Grinnell Corporation, 02/92), 16 pages.

(List continued on next page.)

*Primary Examiner*—Ed Tolan
(74) *Attorney, Agent, or Firm*—Fish & Richardson, P.C.

(57) ABSTRACT

A cold rolling apparatus includes a forming roll which applies a forming load to a tube when cold rolling the tube, and a hydraulic positioning assembly including a positioning roller disposable for initial contact with a tube surface and arranged to apply a positioning load to the tube. A hydraulic circuit is coupled to the forming roll and to the hydraulic positioning assembly such that the positioning load is related to the forming load. A face plate mounted for movement with the forming roll, and the positioning roller is mounted to the face plate. The face plate is coupled to a piston of the hydraulic positioning assembly for movement with the piston relative to the forming roll. The piston is housed within a cylinder body coupled to a guide block which is coupled to the forming roll. The forming roll is an outside roll, and the cold rolling apparatus includes two positioning rollers.

9 Claims, 3 Drawing Sheets othpub

OTHER PUBLICATIONS

"Ridge Tool Subsidiary Emerson Electric Co.", Model 9181–1 Roll Grooving Machine Literature, (Rigid Tool Company, 1996).

"The Fastest Roll Grooving Machine in is Class?", Distributor New Product Update, (Ridge Tool Company Information Line Addendum . . . Jun. 1996).

"Mechanical Piping Systems", (Victaulic), 4 pages.

"Pipe Preparation Tools", (Vitaulic , 3 pages.

"Pace Pipe Processing Equipment," (Pace Machinery Group, Inc.), 3 pages.

"Gruvlok Copper Method", (Grinell Supply Sales Company, Mar. 1994), 3 pages.

"Gruvlok Copper–Prep", Model 1041C Roll Groover Operating Instructions, (Grinnell Supply Sales Company), 2 pages.

* cited by examiner

HYDRAULIC POSITIONING ASSEMBLY FOR COLD ROLLING TUBES

This application claims the benefit of U.S. Provisional Application No. 60/146,848, filed Aug. 3, 1999 which claims benefit of Provisional Application. No. 60/146,849 filed Aug. 3, 1999.

BACKGROUND OF THE INVENTION

This invention relates to positioning roller assemblies for cold rolling tubes.

During cold rolling, the tube is typically offset angularly from the centerline of grooving roller contact surface so that the tube continuously feeds itself into the grooving machine. It has been known to use a guide roller positioned to the side of the tube to offset the axis of the tube so that the user does not have to manually offset the tube while the tube is being cold rolled.

When cold rolling a groove in a tube, the end of the tube being cold rolled has a tendency to flare. Flaring is increased when the opposite end of the tube angles upward from horizontal. When cold rolling longer tubes, e.g., longer than about 4 or 5 feet, flaring is minimized because the weight of the tube itself prevents it from angling upward.

Large diameter extruded tubes often have a non-uniform wall thickness. The forces applied when roll grooving can vary due to the varying wall thickness, and cause the grooved end of the tube to be off axis from the remainder of the tube.

U.S. Pat. No. 5,778,715, to Lippka et al., the complete disclosure of which is hereby incorporated by reference, discloses a positioning roller assembly for use when cold rolling a tube. The positioning assembly includes two positioning rollers rotatably mounted to a positioning plate and disposed for initial contact with a tube surface. The positioning plate is spring coupled to a support for an outside roller, which acts with an inside roller to shape the tube. This coupling maintains contact of the positioning rollers relative to the tube surface when the outside roller is moved during, e.g., groove rolling. The spring mechanism allows for some small variation in tube thickness, applying an increased load when a thicker portion of tube is passing through the groove rolls, and a reduced load when a thinner section is passing through the groove rolls, which follows the load applied by the outside groove roll.

SUMMARY OF THE INVENTION

According to one aspect of the invention, a cold rolling apparatus includes a forming roll which applies a forming load to a tube when cold rolling the tube, and a hydraulic positioning assembly including a positioning roller disposable for initial contact with a tube surface and arranged to apply a positioning load to the tube.

Embodiments of this aspect of the invention may include one or more of the following features.

A hydraulic circuit is coupled to the forming roll, e.g., an outside roll, for applying the forming load to the tube. The hydraulic positioning assembly is coupled to the hydraulic circuit such that the positioning load is related to the forming load. The hydraulic positioning assembly includes a face plate mounted for movement with the forming roll, and the positioning roller is mounted to the face plate. The hydraulic positioning assembly includes a piston and the face plate is coupled to the piston for movement with the piston relative to the forming roll. The piston is housed within a cylinder body coupled to a guide block which is coupled to the forming roll. The cold rolling apparatus includes two positioning rollers.

According to another aspect of the invention, a method of applying a positioning load to a tube during cold rolling includes placing the tube between an inside roll and an outside roll, placing a positioning roller against a surface of the tube, applying a forming load to the tube with the outside roll through a hydraulic circuit, and applying a positioning load to the tube with the positioning roller through the hydraulic circuit such that the positioning load is related to the forming load.

According to another aspect of the invention, a hydraulic assembly for controlling movement of a positioning roller assembly of a cold rolling apparatus includes a hydraulic cylinder body configured for coupling to a forming roll of the cold rolling apparatus for movement therewith, and a piston housed by the cylinder body for movement relative to the cylinder body. The piston is adapted for coupling to the positioning roller. A hydraulic line has a first end coupled to the hydraulic cylinder and a second end coupled to a fitting.

The hydraulic positioning cylinder can be provided as part of a retrofit kit to upgrade existing spring-actuated positioning mechanisms.

The coupling of the hydraulic load to the forming roll and the positioning roller maintains the loads applied to the tube by the forming roll and the positioning roller at a constant ratio, even during rolling of tubes of uneven thickness. This advantageously reduces the tendency of tubes of uneven thickness to form off-axis ends.

Other advantages and benefits of the present invention will be apparent from the following detailed description and the accompanying drawings.

DETAILED DESCRIPTION OF THE INVENTION

Figure 1:
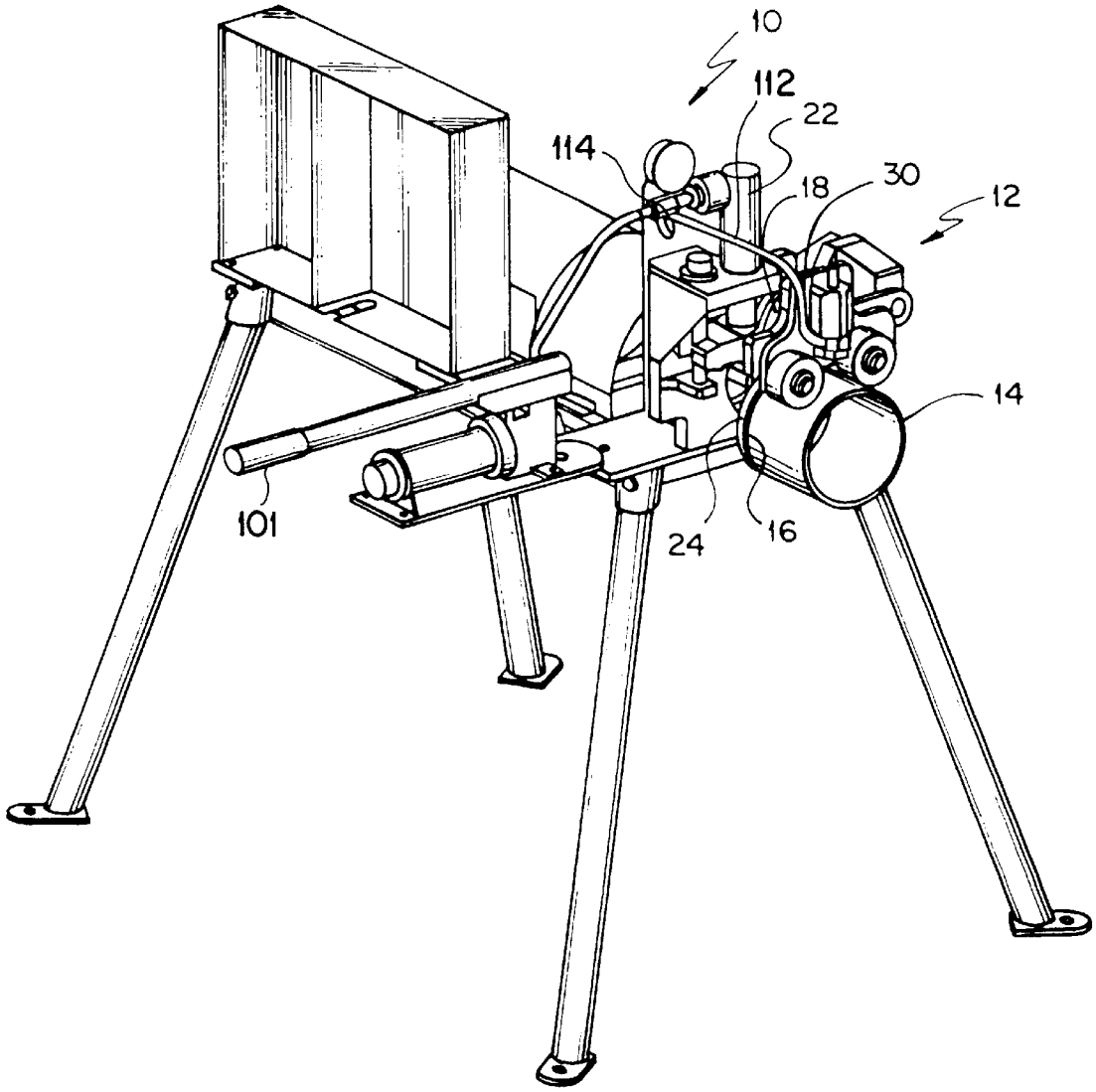
FIG. 1 is a diagrammatic representation of a cold rolling machine.

Referring to FIG. 1, a cold rolling machine 10 includes a rolling assembly 12 for positioning and cold rolling a tube 14 to form, e.g., a groove 16 near an end 24 of tube 14. As used throughout this disclosure, the term "tube" includes any tube, pipe or fitting element which can be cold rolled. Rolling assembly 12 includes an outside groove roll 18 and an inside groove roll 20 (see FIG. 3). A manually operated hydraulic ram 22 lowers outside groove roll 18 to act against tube 14 positioned on inside groove roll 20. Mounted for movement with outside groove roll 18 is a hydraulically actuated positioning roller assembly 30 enabling hands-off feeding of tube 14 between groove rolls 18, 20.

Figure 2:
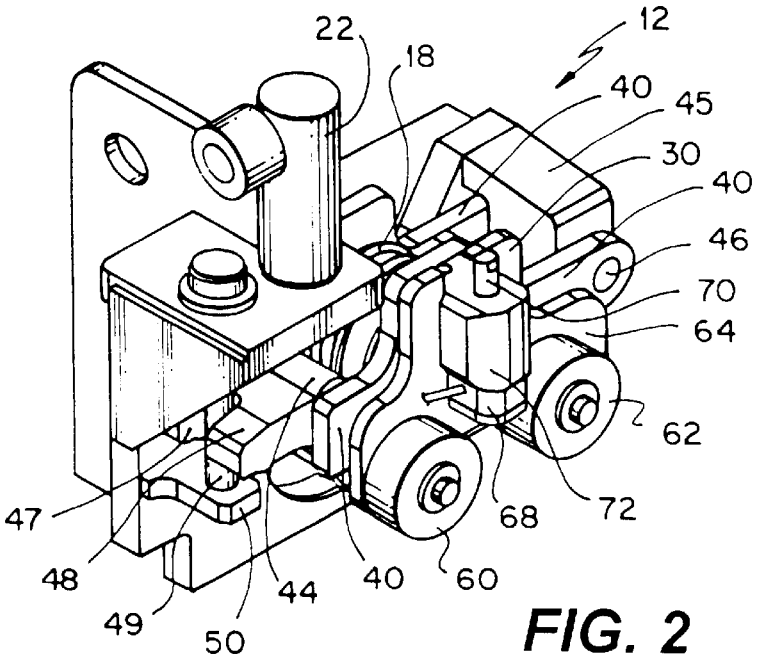
FIG. 2 shows a rolling assembly of the cold rolling machine of FIG. 1 including a hydraulic positioning roller assembly, according to the invention.
Figure 3:
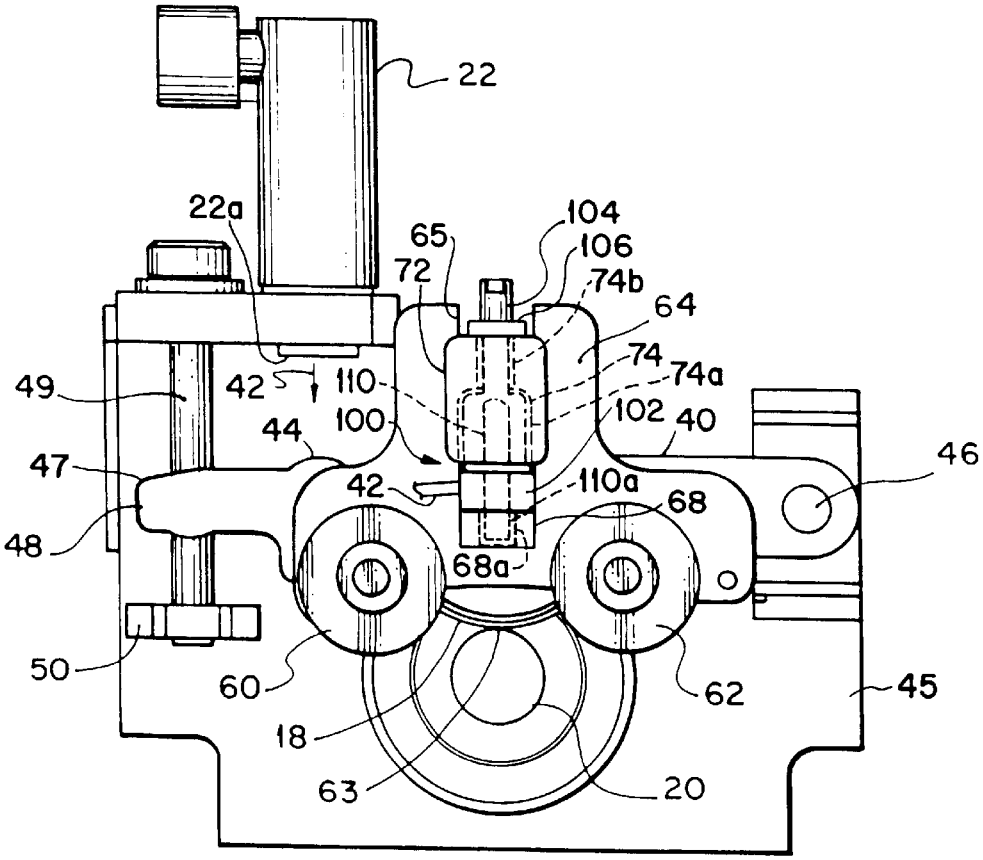
FIG. 3 is an end view of the rolling assembly of FIG. 2.

Referring to FIGS. 2 and 3, rolling assembly 12 includes a pivot arm 40 to which outside groove roll 18 is rotatably mounted, and to which positioning roller assembly 30 is mounted, as described further below. Hydraulic ram 22 includes a piston 22*a* that is lowered (arrow 42) to contact a surface 44 of pivot arm 40 to lower outside groove roll 18 and positioning roller assembly 30 by pivoting motion of pivot arm 40 relative to a rolling assembly frame 45 about a pivot point 46. Pivot arm 40 includes an extension 48 with a notched section 47 which runs along a threaded guide rod 49. The position of pivot arm 50 is adjusted by rotation of guide rod 49. A depth stop 50 threadedly connected to guide rod 49 limits the depth to which pivot arm 40 can be lowered.

Positioning roller assembly 30, which is particularly suited for producing a groove in a short length of tubing, e.g., steel piping having a length as short as about 4.5 inches and a diameter in the range of about 2–12 inches, includes first and second positioning rollers 60, 62. Rollers 60, 62 are rotatably mounted to a face plate 64. Face plate 64 defines a slot 65, and pivot arm 40 includes a guide block 72 which slides within slot 65. Guide block 72 defines a through bore 74 having a first section 74*a* and a second section 74*b* of smaller diameter than section 74*a*. Integral with face plate 64 is a mating member 68 defining a through bore 68*a*.

When pivot arm 40 is lowered, roller 62 contacts tube 14 followed by roller 60 contacting the tube. This produces a relatively greater force between roller 62 and the tube than between roller 60 and the tube. During cold rolling, the differential load causes tube 14 to seek to reposition itself to equalize the loads, thus offsetting tube 14 sideways from a line of contact 63 between outside and inside rolls 18, 20, e.g., by about ¼°. The offset restricts tube 14 from feeding itself out of the cold rolling machine 10 during groove rolling. Rollers 60, 62 also provide a downward load on tube 14, explained further below, which positions tube 14 at a downward angle from line of contact 63 of, e.g., about ¼°, to reduce flaring of the tube end 24 during grooving (see FIG. 1). This combination of the tube being offset and the downward load on the tube enables hands-off feeding of the tube between groove rolls 18, 20.

Figure 4:
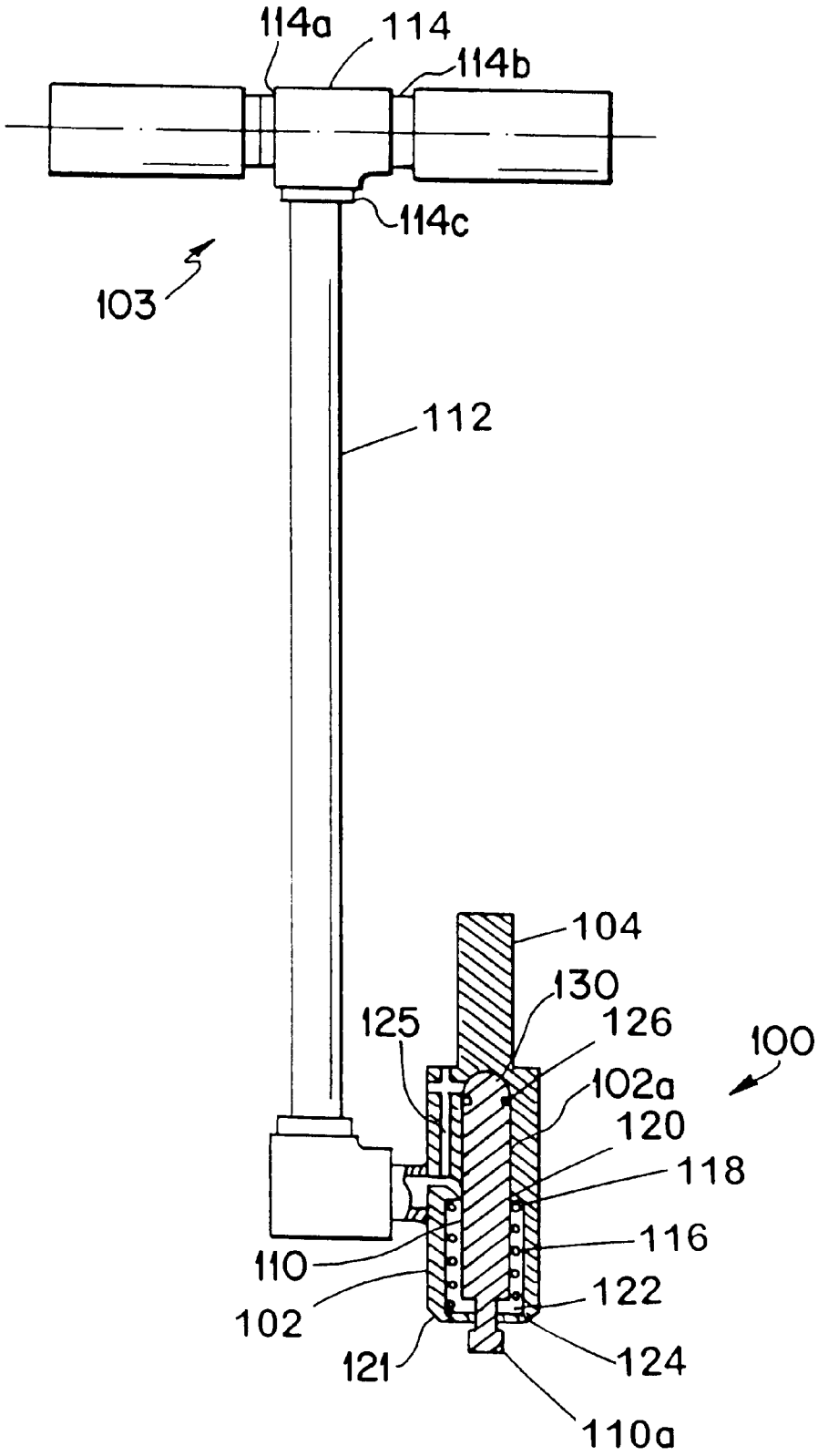
FIG. 4 is cross-sectional view of the hydraulic positioning roller assembly of FIG. 2.

Referring also to FIG. 4, coupling pivot arm 40 and face plate 64 is a hydraulic assembly 100. Hydraulic assembly 100 includes a cylinder body 102 positioned partially within bore section 74*a* of guide block 72, and a threaded rod 104 extending from cylinder body 102. Rod 104 passes through bore section 74*b* of guide block 72 and is secured to guide block 72 with a nut 106. Housed within cylinder body 102 is a hydraulic piston 110 with a threaded end 110*a* which screws into threaded through bore 68*a* of mating member 68. Piston 110 is provided with a smaller cross-sectional area than that of ram piston 22*a*. In the described embodiment, the ratio of the area of ram 22 piston to the area of positioning cylinder piston 110 is about 11:1. This ratio can be different for rolling different size tubes.

Referring to FIGS. 1 and 4, hydraulic pressure is supplied to ram 22 and hydraulic assembly 100 by a hand-pumped source of hydraulic pressure 101 through a hydraulic circuit 103 such that the same pressure applied to ram 22 is applied to hydraulic assembly 100. Hydraulic circuit 103 includes a T-fitting 114 having an inlet 114*a*, a first outlet 114*b* which couples to ram 22, and a second outlet 114*c* which couples to hydraulic assembly 100 via a hydraulic line 112. Since the same hydraulic pressure is supplied to ram 22 and hydraulic assembly 100, the positioning load changes directly with the load applied by ram 22 to outside groove roll 18. The ratio of the loads is constant. However, since the diameter of piston 110 is smaller than the diameter of piston 22*a*, the load applied to positioning rollers 60, 62 is less than the load applied to outside roll 18.

Piston 110 is received within a bore 102*a* defined by cylinder body 102, and retained within bore 102*a* by a compression spring 116. Cylinder body 102 defines a shelf 120 and a groove 121 in bore 102*a*. Located within groove 121 is a lock ring 122. Spring 116 is positioned between a first flat washer 118, which is attached to piston 110, and lock ring 122. Upward movement of piston 110 is limited by piston 110 contacting the top 130 of bore 102*a*, and downward movement of piston 110 is limited by solid compression of spring 116 against lock ring 122. Hydraulic O-rings 124, 126 provide seals. Hydraulic fluid delivered through line 125 defined in cylinder body 102 controls movement of piston 110.

To mount face plate 64 to guide block 72, end 110*a* of hydraulic piston 110 is screwed into threaded hole 68*a* in mating member 108 to secure hydraulic assembly 100 to face plate 64. Piston 110, which rotates freely within cylinder body 102, may include wrench flats to assist in screwing piston 10 into mating member 68. Hydraulic cylinder 100 with face plate 64 attached thereto is then inserted into guide block 72 from below such that threaded rod 104 passes through bore 74 and guide block 72 is positioned within slot 65. Nut 106 is then secured to rod 104. Alternatively, positioning cylinder 100 can be secured to guide block 72 before screwing piston 110 into mating member 68.

In use for forming a groove in tube 14, the positions of outside roll 18 and positioning rollers 60, 62 are initially set using ram 22. The desired loads can be determined experimentally, with too small a load allowing undesired flaring of tube end 24 and too large a load forming an undesired inverse flare.

Groove rolling is begun by further lowering outside roll 18 using ram 22. It is desirable that while outside roll 18 lowers, positioning rollers 60, 62 (while applying a downward load on tube 14 to reduce flaring of tube end 14) remain substantially stationary, thereby reducing the tendency of tube 14 to be bent at a downward angle by undesirable downward motion of the rollers. Having a smaller cross-sectional area than ram piston 22*a*, hydraulic piston 110 serves to allow relative motion between outside roll 18 and positioning rollers 60, 62. As pivot arm 40 and outside roll 18 lower by the depth, d, of the groove, piston 110 (and thus face plate 64) moves upward, resulting in rollers 60, 62 remaining substantially stationary. If positioning rollers 60, 62 were permitted to lower with outside groove roll 18, too high a load would be placed on tube 14 by the positioning rollers producing undesirable inverse flaring. A short length of tubing can thus be cold rolled in a hands-off process with the tube remaining substantially straight.

If a thick section of the tube passes between inside and outside groove rolls 20, 18, the piston in ram 22 is forced upwards, increasing hydraulic pressure in line 112. This increases the positioning load applied by positioning cylinder 100, which counteracts the tendency of that end of the tube to rise up with the increased load at groove rolls 18, 20. When a relatively thinner portion of the tube passes between groove rolls 18, 20, the load applied by ram 22 decreases, reducing the pressure in line 112, and commensurately reducing the positioning load applied by hydraulic assembly 100, keeping the tube more level. This reduces the tendency of tubes of uneven thickness to form off-axis ends.

Although the described positioning mechanism incorporating a hydraulic positioning cylinder is particularly useful when groove rolling large diameter extruded copper tubes which tend to flare, it is also useful in groove rolling or otherwise cold rolling tubes made of different materials and tubes that are not extruded.

The hydraulic positioning assembly shown in FIG. 4 can be provided as a retrofit kit to upgrade existing spring-actuated positioning mechanisms.

Piston 110 can be coupled to face plate 64 by other arrangements, such that piston 110 supports face plate 64 when rollers 60, 62 are not positioned against a tube, and such that the positioning load is transferred from the piston to a tube against which rollers 60, 62 are positioned.

Other embodiments are within the scope of the following claims.

What is claimed is:

1. A cold rolling apparatus, comprising:

a forming roll which applies a forming load to a tube in a first direction and from a first side of the tube when cold rolling the tube, and a hydraulic positioning assembly including a positioning roller disposable for initial contact with a tube surface and arranged to apply a positioning load to the tube, the hydraulic positioning assembly configured to provide movement of the positioning roller relative to the forming roll, the forming roll and positioning roller being arranged such that the positioning load is generally directed in said first direction of the forming load and from the same first side of the tube.

2. The cold rolling apparatus of claim 1 further comprising a hydraulic circuit coupled to the forming roll for applying the forming load to the tube, the hydraulic positioning assembly being coupled to the hydraulic circuit such that the positioning load is related to the forming load.

3. The cold rolling apparatus of claim 1 wherein the hydraulic positioning assembly includes a face plate mounted for movement with the forming roll, and the positioning roller is mounted to the face plate.

4. The cold rolling apparatus of claim 3 wherein the hydraulic positioning assembly includes a piston and the face plate is coupled to the piston for movement with the piston relative to the forming roll.

5. The cold rolling apparatus of claim 4 wherein the hydraulic positioning assembly includes a cylinder body housing the piston, the cylinder body being coupled to a guide block which is coupled to the forming roll.

6. The cold rolling apparatus of claim 1 wherein the forming roll is an outside roll.

7. The cold rolling apparatus of claim 1 including two positioning rollers.

8. A cold rolling apparatus, comprising:

an outside roll which applies a forming load to a tube when cold rolling the tube, a hydraulic positioning assembly including a face plate mounted for movement with the outside roll and positioning rollers mounted to the face plate, the positioning rollers being disposable for initial contact with a tube surface and arranged to apply a positioning load to the tube, the hydraulic positioning assembly further including a cylinder body coupled to the outside roll and housing a piston, the face plate being coupled to the piston for movement with the piston relative to the outside roll, and a hydraulic circuit coupled to the outside roll for applying the forming load to the tube, the hydraulic positioning assembly being coupled to the hydraulic circuit such that the positioning load is directly related to the forming load.

9. A method of applying a positioning load to a tube during cold rolling, comprising:

placing the tube between an inside roll and an outside roll, placing a positioning roller against a surface of the tube, applying a forming load to the tube in a first direction and from a first side of the tube with the outside roll through a hydraulic circuit, and applying a positioning load to the tube with the positioning roller through the hydraulic circuit, the hydraulic circuit configured to provide movement of the positioning roller relative to the forming roll, the forming roll and positioning roller being arranged such that the positioning load is generally directed in said first direction of the forming load and from the same first side of the tube.

* * * * *

UNITED STATES PATENT AND TRADEMARK OFFICE

CERTIFICATE OF CORRECTION

PATENT NO. : 6,408,664 B1
DATED : June 25, 2002
INVENTOR(S) : James O. Williams

It is certified that error appears in the above-identified patent and that said Letters Patent is hereby corrected as shown below:

Column 4,
Line 17, please change "10" to -- 110 --.

Signed and Sealed this

Twenty-first Day of January, 2003

JAMES E. ROGAN
*Director of the United States Patent and Trademark Office*